US005136476A

United States Patent [19]

Horn

[11] Patent Number: 5,136,476

[45] Date of Patent: Aug. 4, 1992

[54] TOILET BOWL ILLUMINATOR

[76] Inventor: Donald E. Horn, 1571 Hightower Dr., Uniontown, Ohio 44685

[21] Appl. No.: 704,964

[22] Filed: May 23, 1991

[51] Int. Cl.[5] ..... F21E 7/00

[52] U.S. Cl. ..... 362/198; 362/802

[58] Field of Search ..... 362/198, 101, 800, 802

[56] References Cited

U.S. PATENT DOCUMENTS

| | | | |
|---|---|---|---|
| 2,467,954 | 4/1949 | Becker | 362/198 |
| 2,964,677 | 12/1960 | Tucker et al. | 315/309 |
| 3,103,723 | 9/1963 | Becker | 362/198 |
| 3,737,722 | 6/1973 | Scharlack | 362/198 |
| 3,862,410 | 1/1975 | Maxwell | 362/198 |
| 4,329,625 | 5/1982 | Nishizawa et al. | 362/800 |
| 4,860,178 | 8/1989 | Picon | 362/802 |
| 4,891,563 | 1/1990 | Ganser et al. | 315/309 |
| 5,034,847 | 7/1991 | Brain | 362/802 |

*Primary Examiner*—Carroll B. Dority

*Attorney, Agent, or Firm*—Donald A. Bergquist

[57] ABSTRACT

An easily-installed, portable illuminator for the illuminating of toilet bowls is disclosed. More specifically, the illuminator of this disclosure hangs on the rim of a toilet bowl by a tubular conduit through which electrical conductors carry current from a battery pack or other power source external to the bowl and to a light source suspended within the bowl. Light-sensitive and manual switches and current-regulating circuitry are options on advanced embodiments.

16 Claims, 1 Drawing Sheet

TOILET BOWL ILLUMINATOR

INTRODUCTION

An easily-installed, portable illuminator for the illuminating of toilet bowls is provided. More specifically, the illuminator of this disclosure hangs on the rim of a toilet bowl by means of a tubular conduit through which electrical conductors carry current from a battery pack external to the bowl to a light source within the bowl. Light-sensitive and manual switches are options on advanced embodiments.

BACKGROUND

The present invention relates to the lighting of the inside of a toilet bowl and the immediate environs thereof without the necessity of activating the overhead room lights by means of a wall switch or other switching means.

Adults who require the need to use a toilet in the middle of the night often find that the switching on of room lighting irritates one's eyes that have become accustomed to the dark and creates temporary disorientation. Extinguishing the room lighting afterward also creates another disorientation while the eyes gradually become reacclimated to the darkness.

Additionally, adults with small children who are incapable of reaching the wall switch, often find that they are awakened in the middle of the night by the child in order to accompany the child to the toilet because of the child's inability to reach the wall switch. The same disorientation is present for child and adult.

The present invention provides a novel toilet bowl light that is operable in any of several modes: it may be operable 24 hours a day; it may be operable during darkness only by means of a light-sensitive switch; or it may be operable by means of a manually-operative switch. Leakage of light from the toilet bowl, even through the space beneath the toilet seat and the toilet lid, serves as a guide for one with darkness-acclimated eyes to find the toilet in an otherwise totally dark environment, whether the toilet seat and lid are raised or lowered. The low light level does not create eye irritation and disorientation to darkness-acclimated eyes but provides sufficient light to see the bowl and its immediate environs. At such low light levels, the eyes do not become light-acclimated to the extent room lighting would produce, so that return to bed in the darkness is less dangerous.

Prior art uncovered in the U.S. patent literature under Patent Office classification numbers 4/661, 362/190, and 362/191 include three toilet light units, none of which are seen to anticipate or make obvious the present invention.

U.S. Pat. No. 4,413,364, issued to Bittaker et al in 1983, teaches a battery-operated light to be adhesively mounted on a toilet bowl at a location between the hinge mounts and features a mercury switch on the underside of the toilet seat to turn on the light only when the seat is raised. In contrast, the present invention offers guidance to the user without lifting the toilet seat and is installed without attachment or mounting to the seat or to the lid, and thereby provides both greater ease in installing and portability. The present invention could even be used while staying overnight while traveling.

U.S. Pat. No. 4,736,471, issued to Johnson in 1988, teaches a battery-powered light that mounts on the underside of the toilet lid and operates by means of a mercury switch when the lid is raised. In contrast, the present invention offers guidance to the user without lifting the toilet lid and is installed without attachment or mounting to the seat or to the lid.

U.S. Pat. No. 4,860,178, issued to Picon in 1989, teache a battery operated light that mounts on the underside of the toilet seat with the lamp positioned to be within the rim of the toilet bowl when the seat is down. Included in the teachings of this patent is a manual switch as well as an automatic gravity-operated switch. In contrast, the present invention is installed without attachment or mounting to the seat or to the lid.

SUMMARY OF THE INVENTION

It is an object of this invention to provide apparatus to illuminate a toilet bowl by means of a light source within the bowl supported by means interconnecting this light source with an electrical power source without the bowl wherein both the light source and the power source are suspended by said interconnecting means.

It is another object of this invention to provide such apparatus wherein the light source is a light emitting diode (LED).

It is another object of this invention to provide such apparatus wherein the power source comprises electrochemical cells.

It is another object of this invention to provide such apparatus wherein the interconnecting and supporting means comprises electrical leads of sufficiently heavy gauge to be bent to a shape to support the entire apparatus from the rim of the toilet bowl.

It is another object of this invention to provide such apparatus wherein the interconnecting and supporting means comprises electrical leads and an elongated pliable stiffening element that may be bent to a shape to support the entire apparatus from the rim of the toilet bowl.

It is yet another object of this invention to provide such apparatus wherein a light-sensing switch breaks the current path for the light source when the environment surrounding it is otherwise lighted.

It is yet another object of this invention to provide suc apparatus wherein a manual switch is present to selectively light or extinguish the light source when desired.

DETAILED DESCRIPTION OF THE INVENTION

Figure 1:
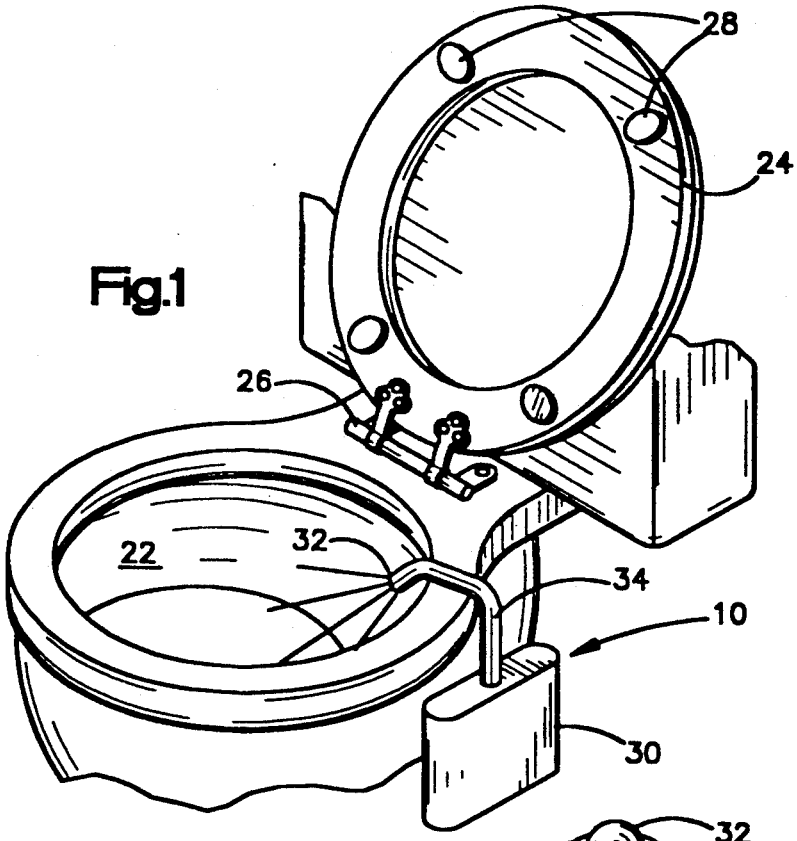
FIG. 1 illustrates the article of the present invention as installed on the rim of a toilet bowl.

FIG. 1 illustrates the present invention 10 as it is installed for use hanging over the rim 20 of a toilet bowl 22. An electrical power source, comprising most of the weight of the entire unit, is contained within an enclosure 30 suspended externally to the toilet bowl 22 and below the rim, thereby to provide stability to the entire unit by positioning the majority of the weight substantially lower than the point of support (i.e., the rim of the bowl). A light source 32, being an electric lamp or (in a preferred mode) a light emitting diode (LED) is suspended internally to the toilet bowl 22, thereby to illuminate the bowl and, by light reflected therefrom, the area immediately surrounding the bowl. It has been found that a diode emitting substantially green light gives the combined benefits of low power requirements, suitable illumination, and adequate visibility from a distance for guiding the user in a darkened room. The interconnecting wiring is housed in a waterproof tube 34 that rests on the rim 20 of the toilet bowl 22 beneath the toilet seat 24. The tube is not crushed because of the space between the seat and the rim of the toilet bowl created by the spacing of the hinge 26 and the bumpers 28 attached to the underside of the seat. Obviously, the entire unit 10 may be installed or removed at will for transfer to another toilet bowl.

Figure 2:
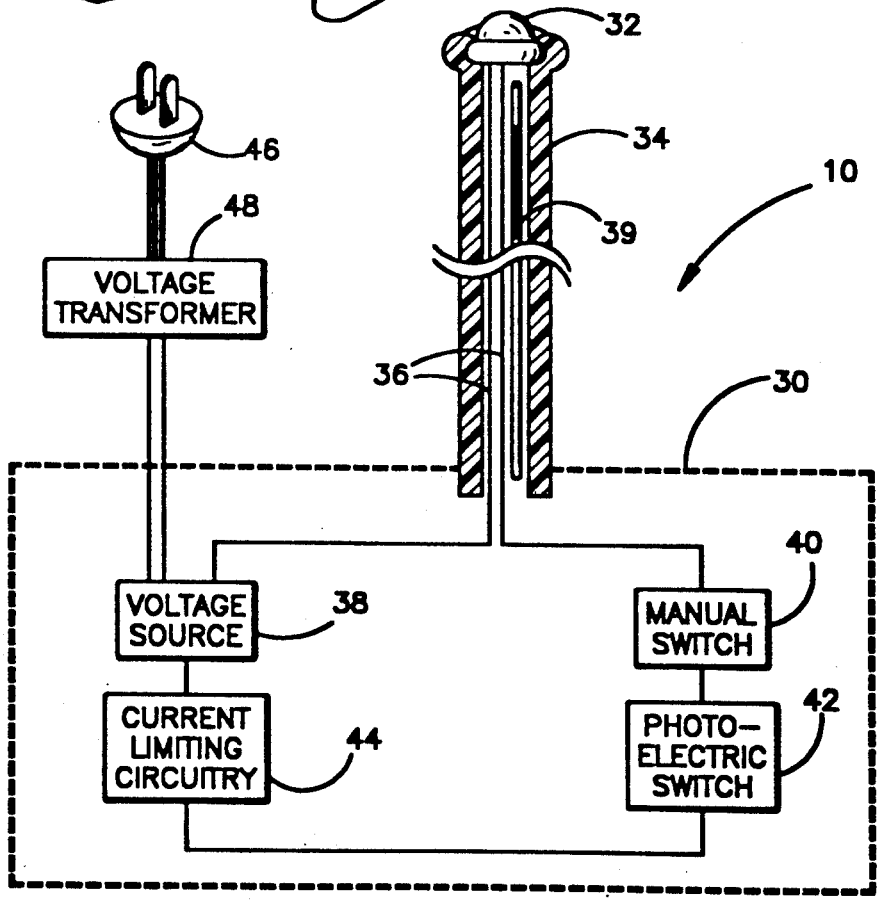
FIG. 2 illustrates in a schematic block diagram the electrical circuit of the present invention.

Details of the electrical circuit providing electrical power to the light source are illustrated in FIG. 2. The means by which the light source 32 and the enclosure 30 for the power source are interconnected is a waterproof tubing 34 that encloses the electrical conductors 36 that carry electrical current from the power source 38 to the light source 32.

In one embodiment, the waterproof tubing 34 has sufficient strength and deformability to be bent to be formed around the rim of the toilet bowl to support the light source and the enclosure for the power source. In this embodiment, the tubing 34 could be of a soft metal, such as copper, or of a plastic material.

In another embodiment, the waterproof tubing 34 is not sufficiently rigid to be formed around the rim of the toilet bowl to suport the light source and the enclosure for the power source, so a stiffening element 39 must be provided within the tubing or molded or extruded as a part thereof.

In the preferred embodiment, at least one of the conductors 36 running through the waterproof tubing 34 has sufficient strength and deformability to be bent to give internal support to the tubing as it is formed around the rim of the toilet bowl to support the light source and the enclosure for the power source.

Included in the schematic block diagram shown in FIG. 2 are several optional elements that combine to form the best mode. These options include manual and photosensitive switches, current limiting circuitry and an external power source.

A manual switch 40 may be provided in the circuit. This switch would be used to manually interrupt the circuit to extinguish the light source. This switch may disable the circuit during storage or transport of the invention, or for disabling it during periods when the invention is otherwise not to be used, as when one is away from the home for extended periods of time.

A photosensitive switch 42 may be provided in the circuit to automatically extinguish the light source when the room is lighted by room lighting or by sunlight, when the benefits of a lighted toilet bowl are not needed.

Current-limiting circuitry 44 has been found by experiment to be a desirable feature to prolong the life of the voltage source when electrochemical cells (i.e. batteries) are used to power the light source. Tests have shown that there is a temperature effect on the life of the batteries used in the operation of this invention with an LED light source. A simple resistor as a current limiting circuit has been used in tests. A thermisor with a negative temperature coefficient may be desirable for use in place of a simple resistor. Thus, if the ambient temperature rises, the thermistor provides a higher resistance, thereby reducing current flow. Even more sophisticated current limiting circuitry may be obvious to one skilled in the art. Suffice it to say that in the best mode it is desirable to limit the current flow to prolong the life of the batteries.

As mentioned in the previous paragraph, a convenient voltage source 38 for this invention is an electrochemical cell. As an alternative, an alternating current source 46, as is typically available in homes to power lamps and appliances, may be used as a voltage source for the present invention. For the sake of safety, it is preferred that a step-down transformer 48 and adequate fuse protection be used at the electrical outlet, to provide at the enclosure 30 a safe, low-voltage power source that may be used around plumbing fixtures. A ground-fault interrupter may be required by local electrical codes for such an embodiment of the present invention.

Thus, in the best mode, the invention comprises a green light-emitting diode connected by means of relatively heavy-gauge conductors running through a waterproof conduit to a battery enclosure, the electrical circuit also including a photo-sensitive switch, a manual switch, and current-limiting circuitry, as well as the battery voltage source.

Advantages of the present invention include the ease of installation, portability for transfer to toilet bowls away from the residential environment (such as in boats, campers, or motorized recreational vehicles, in motels or hotels while traveling, or in hospitals or nursing homes, especially for the elderly), low light levels to prevent light acclimating of the eyes, and continuous illumination to provide guidance to the toilet bowl in an otherwise darkened room.

Having described his invention, including a totally functional specific example thereof, applicant desires to include within the scope of his invention those improvements that would be immediately obvious to one skilled in the art, some, but not all of which improvements have been referred to herein. Applicant desires the breadth of his invention to be limited only by the scope of the claims appended hereto.

I claim:

1. A toilet light comprising:

a. a housing containing electrical connections for a voltage source;

b. an electrical light source;

c. an electrical circuit comprising said voltage source and said light source; and d. means interconnecting and supporting said housing and said light source and comprising two electrical conductors of said electrical circuit, within a tubular covering having substantially rigid U-shaped portion adapted to substantially conform to and rest upon the rim of a toilet bowl, thereby to support said housing without said toilet bowl and said light source within said toilet bowl to illuminate the space within said toilet bowl and the immediate environs.

2. The toilet light of claim 1 wherein said tubular covering comprises a waterproof tubing.

3. The toilet light of claim 2 wherein said tubing is bendable tubing that will retain a shape to which it is bent.

4. The toilet light of claim 3 wherein said tubing is copper tubing.

5. The toilet light of claim 2 wherein said tubing is stiffened by an elongate internal stiffening element that will retain a shape to which it is bent.

6. The toilet light of claim 2 wherein at least one of said electrical conductors will retain a shape to which it is bent for the purpose of supporting said housing and said lamp.

7. The toilet light of claim 1 wherein said electrical light source is a light-emitting diode.

8. The toilet light of claim 7 wherein said light-emitting diode emits light that is substantially green in color.

9. The toilet light of claim 1 wherein said electrical light source is an incandescent lamp.

10. The toilet light of claim 1 wherein said voltage source comprises an electrochemical cell.

11. The toilet light of claim 1 wherein said voltage source comprises a household electrical current source.

12. The toilet light of claim 1 wherein said electrical circuit comprises a manual switch to interrupt the flow of electricity through said circuit.

13. The toilet light of claim 1 wherein said electrical circuit comprises a photoelectric switch to interrupt the flow of electricity through said circuit when ambient light is present.

14. The toilet light of claim 1 wherein said electrical circuit comprises current-limiting circuitry to limit the flow of electricity through said circuit.

15. The toilet light of claim 14 wherein said current limiting circuitry comprises a resistor.

16. The toilet light of claim 14 wherein said current limiting circuitry comprises a thermistor.

* * * * *